United States Patent [19]

Schmidt et al.

[11] 4,135,440

[45] Jan. 23, 1979

[54] METHOD AND APPARATUS FOR VENTILATING OR AIR CONDITIONING OCCUPIED ROOMS

[76] Inventors: Friedrich H. Schmidt; Fritz Reuter, both of Hohenzallernring 51, Cologne, Fed. Rep. of Germany, 5000

[21] Appl. No.: 694,573

[22] Filed: Jun. 10, 1976

[30] Foreign Application Priority Data

Jun. 11, 1975 [DE] Fed. Rep. of Germany ..... 2525917

[51] Int. Cl.[2] ..... F24F 13/10

[52] U.S. Cl. ..... 98/31; 98/40 A; 98/40 D

[58] Field of Search ..... 98/33, 32, 40 D, 40 N, 98/40 A, 36, 115 L, 115 H, 31; 62/261

[56] References Cited

U.S. PATENT DOCUMENTS

| | | | |
|---|---|---|---|
| 760,182 | 5/1904 | Chapman et al. | 98/37 |
| 1,194,527 | 8/1916 | McNamara | 98/32 |
| 2,692,547 | 10/1954 | Ericson | 98/40 D |
| 3,049,067 | 8/1962 | Claude | 98/31 |
| 3,422,600 | 1/1969 | Chamberlain | 98/40 D |
| 3,726,204 | 4/1973 | Lindeström | 98/40 N |
| 3,923,482 | 12/1975 | Knab et al. | 98/36 |
| 3,949,522 | 4/1976 | Kehl et al. | 98/40 C |

FOREIGN PATENT DOCUMENTS

| | | | |
|---|---|---|---|
| 2512679 | 3/1975 | Fed. Rep. of Germany | 98/40 D |

*Primary Examiner*—William E. Wayner
*Attorney, Agent, or Firm*—Michael J. Striker

[57] ABSTRACT

A method for ventilating or air conditioning a room or occupied space comprising dividing the air supplied to the room into a principal air volume appropriately fed into the room at various spots to establish the primary or overall climate of the room and into another, usually lesser volume distributed at one or more work places or zones regularly occupied by individuals, with adjustment of the latter volume and its flow by the individuals to establish a respective local or zone climate for their specific needs; a room arrangement or building structure affording air conditioning or ventilating by the described method; and specific particular adjustable air outlet heads adjustable without tools preferably in universal fashion at individual work places or zones of occupation.

27 Claims, 14 Drawing Figures

METHOD AND APPARATUS FOR VENTILATING OR AIR CONDITIONING OCCUPIED ROOMS

The present invention is concerned with a method for ventilating and/or air conditioning occupied rooms with provision of individually regulatable room zones and also with the apparatus or devices for air distribution requisite to that end.

Individual regulation of the thermal conditions at each place of large occupied rooms, especially in large office rooms, is of great practical importance, for the ability of persons to concentrate, their enjoyment of life and work performance, are quite notably dependent upon thermal comfort. To afford each person with comfortable thermal conditions, in large rooms it is not sufficient to provide a uniform room climate. For, because of different bodily heat production, different activities and states of health of the individuals, their different clothing habits, and also in consequence of differences in the warmth among wall and window areas of the room, the body heat balance (or heat transfer conditions) of different persons in the room is quite distinct. Therefore no one uniform room climate is simultaneously comfortable for all persons in a large room such as a large office room or the like.

On the other hand, in air conditioned rooms with a constant temperature and air velocity, there is lacking that stimulatory effect which, out of doors in nature, is encountered from all sides and which can be had in some degree in small rooms with the windows open.

By air treating apparatus or installations of the prior art, the air temperature or air humidity or both can be automatically held constant at selectable values, or changed in accordance with a pre-determined program. Within large rooms, by regulation of the heaters, the local temperatures in several individual zones may be controlled. However, this approach engenders considerable problems. Accordingly known air conditioning apparatus or installations offer no possibility of providing, in an acceptable manner, individual zones in work rooms or the like with appreciably different temperatures.

In the case of known air treating apparatus or installations, the velocity of air in the room results from momentum forces, thermal drive or convective forces, and viscosity forces, and is not directly controlled, particularly at individual zones. But still the room air velocity has an essential or basic influence on the heat release or transfer from the human body.

In vehicles, for example in aircraft, air nozzles are used to discharge the air in jets or directed streams of relatively high velocity, which produce enhanced cooling. Also table fans to an extent utilize this same effect. With these arrangements, however, the air streams or jets are not spreadable, that is can not be fanned out, so that the individual air streams or jets have a fixed angle to one another.

Also on the forward edge of fixed desks in lecture halls or auditoriums, air outlets have been used to direct a respective broad air stream over the head of the auditor there seated (see German Pat. No. 1,604,218). Best suited for air distribution into the immediate respective regions of individuals are the rotation-producing air outlets or discharge devices (German Pat. Nos. 1,912,629 and 1,936,200; also British Pat. No. 547,539). These however, do not allow selection of the axial air velocity without tools, and do not provide an adjustment of the air path direction, nor the possibility at all times of individual spreading or broadening of the air discharge streams or jets.

Now the medical profession warns especially against air streams impinging only upon single parts of the body. Hence the known devices utilizing individual air jets or streams to increase air velocity in zonal selection of conditions are not suitable for continual use, since these devices do not permit a selection of the room air velocity in the region at least of the entire upper body.

A principal object of the present invention is to afford in an occupied room, such as a large office or other work room, small zones where thermal conditions are individually adjustable in such fashion that it is not exclusively the room temperature, but also the motion of the air which is regulated.

Accordingly the heat transfer from the skin and clothing is changeable for production of a thermal equilibrium, or perhaps better, a comfortable steady state heat transfer condition, for individual persons; and also there is provided the known refreshing effect similar to that of open windows.

To accommodate fairly the individual requirements of all persons, furthermore there is provided a warm primary or "basic" overall room climate with low air velocity, and at every probable work place or zone of extended occupancy by an individual, by the room arrangement, an apparatus is mountable which permits the adjustment of setting of higher local air velocity, with air velocity available up to a desirable 0.8 m/sec. At the same time through the differed treatment of the respective zones, a better air quality is there provided and energy is conserved for the overall operation.

For the attainment of this object, by this invention the total volume of conditioned air being supplied to the room is divided into two parts or fed into the room in two distinct ways. A first part, as what may be called a "primary" air volume, e.g., a floor-region-fed air volume and by which a primary or basic room climate is achieved, is distributed in the room with a low room air velocity. A second part, as individual supplemental air volumes, so to speak, is introduced in the room by means of individually spreadably adjustable air outlets to provide, for each of the constantly occupied spaces, a "local" climate zone which is distinct from the basic room climate or condition.

The primary air volume, which may amount to from about 10% to 90% of the total supplied air volume, is fed to the room distributed in such fashion that there results a room air velocity of less than 0.1 m/sec with 20C general room temperature, and less than 0.2 m/sec for a 24C general room temperature. For this purpose an essential prerequisite is the smaller primary air quantity as contrasted with the total air quantity supplied. From this unusual air tranquility there results a primary room climate, characterized by a lower convective heat transfer from the human body. The remaining air quantity is introduced through individually adjustable outlets in the respective room work stations or like zones, or is used for temperature variation at times in which it is directed onto heat exchange surfaces or into other regulated temperature controlled room regions.

By a further aspect of the invention, a higher general room air temperature is acceptably used with a reduced total supplied air volume, especially with high room cooling load; and a regulatable cooling effect is achieved through selectable elevation of the room air velocity in a sufficiently large work station or occupancy zone by the individually supplied or supplemental air quantity.

By another inventive aspect, a further advantageous reduction of the total air supply quantity is achieved, since those room occupants with a lower cooling requirement then can partially or completely close off their individually adjustable air outlets.

This has the advantage of a lower total air amount required to be supplied to the room because a higher average room temperature is possible and acceptable than in cases where apparatus or installations are used without individual air velocity control in the fashion here contemplated.

Advantageously an air pressure change or feed air volume change resulting from reduction in air use at individual zones, can be measured, and accordingly a corresponding change of the room supply air condition or its volume can be made. With a corresponding fore pressure or air source pressure regulation, thereby the total air volume can be considerably reduced and also energy correspondingly saved. The fraction of the basic primary air amount can be pre-set to a non-changing quantity, or can be changed in a pre-selected relation resulting from the adjustment of the air outlet.

For introduction of the primary air volume, it is particularly suitable to feed the air from the floor or lower region of the room upwardly, the air being introduced through more or less uniformly spaced or distributed floor gratings. From these, the upwardly directed air streams or jets quickly assume the room temperature from the room air through a high induction effect, and decrease in velocity, having a height of penetration into the room of about 1.0 to 2.5 meters. By this arrangement no cold air pools form on the floor, and lateral spreading of feed air streams into the leg regions of the room occupants is avoided. Similarly structured feed air outlets in columns, flower pots, or furniture are also suitable. So also air outlets in the form of other floor grills, or floor slots or perforations, and even permeable or air penetratable wall-to-wall carpeting are suitable for air introduction.

Furthermore an air introduction from above downwardly is also suitable, if for example, the supply air is finely divided from ceiling grill elements or the like, as is described for example in the published German application OS No. 1,679,529, for air introduction into the room. But also other well distributed ceiling or wall outlets with other air feed conductors can serve for introductions of the basic or primary air volume, if they maintain a quiet air body with extremely low room air velocity.

The work places, or other zones constantly occupied by individual persons, from time to time or continually are specifically individually serviced or treated by means of the remaining supply air for the room. The devices disclosed for the supplemental feed air distribution are located at the individual regions ambient to the room users and are adjustable without tools either individually or as a group. These enable regulation of the room air velocity for a distance of 1 to 2 meters away from the outlets. The effective region of increased room air velocity is large enough, so that the entire upper body of a seated person is contacted by the incoming air.

This is achieved by a spacial division and spreading of the supplemental feed air streams or jets, according to the invention, attained by introducing the air through at least three non-parallel air guiding discharge passages. Adjustment afforded for the passage axes effects an increasingly strong spreading of the introduced air. Consequently the injector effect of the jets is increased, and the momentum of the fed air is imparted to a continually increasing part of the surrounding air. By this means, and through a possible superimposed rotational motion, the velocity along a jet axis decreases in a short distance to about one-quarter of the value which it would have without this spreading of the discharge streams. With a simultaneous narrowing of the air feed passages a still wider spread achieves a higher pressure drop in the discharge or outlet device; and accordingly by a corresponding configuration of the device, the feed air quantity is reduced so that a further reduction of the room air velocity is possible. As an extreme adjustment condition, complete closure of the discharge passage is contemplated. The preferred air outlets can be round, square or rectangular, and adapted to being built into surfaces; but they can also take the form of a ball, roll or any other solid body shape.

For the embodiment of the inventive concepts, various discharge heads or devices are proposed for which commonly there are at least three air feed passages, the resulting corresponding discharge axis directions of which are adjustable. The axis direction can be adjusted up to a range of 90°, in which case the axes or shafts for guide elements can extend radially from an imagined central axis, or can be adjusted tangentially to one or more circular or polygonal lines extending about the central axis. However, where there are at least six air feed passages, it is also contemplated that there be a choice of several central axes with respect to which the adjustment takes place in a correspondingly adapted manner.

With curved passages in the discharge device and with wall elements displaceable relative to one another, the axial path at the passage outlet is determinative of the result achieved. The air discharge passages may have one or more curved walls to produce a gentle or light deflection of the air jets. They may have partially stationary walls or defining elements, which for examle, are formed by the air feed passage; and boundary or defining wall elements which are partially displaceable, bendable or rotatable. They may have partially common defining walls, the inclination of which is adjustable and may during the adjustment procedure change their cross section, in order to increase the resistance to the air flow therethrough, thus to reduce the introduced air quantity, or in order to completely shut off the air supply.

In a modification of the inventive concept, a structural unit is used comprised of at least three air feed passages with diverse axial directions, wherein the control is achieved by opening or throttling of the individual or entire group of air passages, and thereby there is achieved the requisite spread or jet broadening and jet deflection. Further a set of at least three stationary air feed passages may be used in conjunction with shiftable air feed passages.

By a further disclosure, an air outlet device without adjustable passages at the air discharge region, affords adjustment of the resultant axes of the exiting air streams through a change of the flow direction in the air feed passages. Accordingly there is also a better mechanical protection of the adjustment means. Thus the location of the adjustment device, whether visual or not, is not fixed.

The discharge devices of the invention, in addition to selection of the jet or discharge stream velocity, also enable an adjustment of the jet direction. For this purpose in accordance with the possibility of building the units into place, diverse devices are afforded which can be combined with the air outlet.

With some embodiments of the air distribution device of the invention, the consequent jet or discharge stream direction can be changed through adjustment of individual air feed passages. Other modifications are suitable for the purpose, for example, a spherical head is turnable within a spherical socket, whence there results a universal adjustability. Others are disposed on bendable air feed passages of metal, rubber, plastic, and other materials, which additionally can be reinforced with a stress absorbing core or skelton. Likewise the air outlets can be built into devices with one or more pivot, translation, or rotational axes, in which case the shafts or pivots must not be extended through the air outlet mouth or the air passages.

Hand adjustment of the individual air feed passages can be effected through rotational motion at one or more rotational grip or knob elements, or/and one or more adjustment levers, pull knobs or push buttons. But especially for remote control and for control of alternate effects, they can also be activated through pneumatic, hydraulic, or electric forces, or thermal expansion mechanisms, with or without ancillary energy as in servo devices, or through force or energy storing elements, such as springs or suspended weights. A particularly advantageous embodiment comprises a combination of a rotational hand actuation with a clockwork, similar to the known timer alarms, which either continually or after a time lapse restore a rotational position. The force transmission is achieveable through essentially known elements such as levers, gears or friction wheels, cam disks, or through non-contact forces such as magnetism.

For the disposition and reception of the adjustable devices, additional elements commend themselves, which form a unit with the air outlet and can accept a part of the adjustable elements, or can be additional equipment of furniture, window sills, walls, floors or ceilings to be equipped with these outlets.

With air introduction into the room upwardly from the bottom or floor region, there are suitable for example, preferred additional devices, which stand on or are fixed in the floor and at the bottom are connected to an air-conveying double floor structure. The floor connections can be arranged in a fixed "grid", to serve partially for the reception of floor outlets in the above described fashion, partially for the reception of the electrical installations, or to be closed with covers. The additional elements obviously can also accept further installations, which can be illumination elements, flower pots, or acoustical or optically separately operative components. Also the installation in existing structures is contemplated.

Where air is to be introduced from above downwardly, a grid of connection points is arranged on the lower ends of connection passages of the air supplying grid elements, or disposed at the upper edges of the air supplying grid elements, or the connection grid, visible or invisible, is disposed in flat or formed ceiling elements or modules. At these connection points, there are located coupling fittings of basically known form, into which can be connected, as desired, air discharge devices having the above described or special constructions.

The thus designed described air treating equipment, in contrast with prior equipment, has considerable advantages, because it becomes possible to provide in a large room individual room regions or zones with different climate conditions and with these to be individually regulatable. With this method the regions adjacent to such zones are only slightly or not at all affected. The ambient micro-climate conditions are changeable for respective persons through changes of the room air flow in similar fashion, as by change of the room temperature up to several degrees Celsius. The required total air supply can be smaller than in the case of installations without individually treated zones, because here a higher general room temperature level can be accepted, and since with closure of individual air outlets less conditioned air needs to be furnished.

A further advantage accrues to the method, by directing a supplemental air feed stream onto heat exchanging surfaces, and into room zones with diverse temperature conditions.

The air outlet devices contemplated by the invention for regulation of the individual work stations or zones of a room, in contrast to other known air outlets, import the advantage that, in preferable fashion, they may be disposed in the region of individuals, there assuring a direct introduction and encounter with new air, that the local, i.e., zonal, room air velocity is selectable over a wide range, and that the thus affected room zones are changeable in local climate condition.

The air outlets do not produce single air streams, but the air is acted upon by a multiplicity of passages and introduced into the room, and through changing of the angle between resultant streams or through changing of the velocity in the individual passages, is more or less spread out, so that the respectively very favorable flow forms or jet flow directions and/or room air velocities are attained. The change of the air outlets can take place in a multiplicity of modes, and is partially or totally automatable.

Thus, for example, through a retro-positioning device a high setting for the air quantity or air velocity can be reduced to save energy or to avoid an undesired cooling, or to establish a stimiulating room climate. The user of one of the thus-designated work stations or zones himself can establish his own environmental thermal conditions. This is not only physiologically of advantage, but also is psychologically extremely valuable.

Other objects and advantages will appear from the following description and the drawings wherein.

Figure 2:
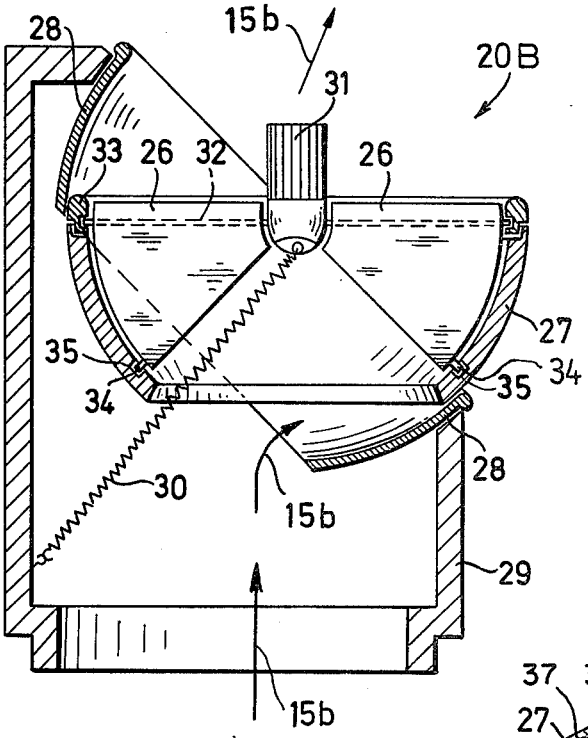
FIG. 2 is a vertical section through an air distributor head or device for an individual room zone, with air deflecting vanes thereof at full open position.
Figure 2E:
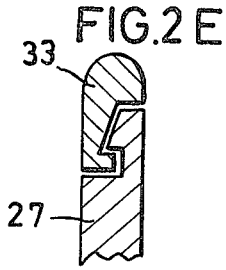
Figure 2B:
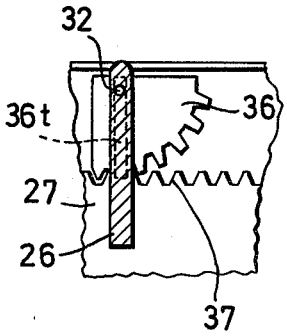
Figure 2A:
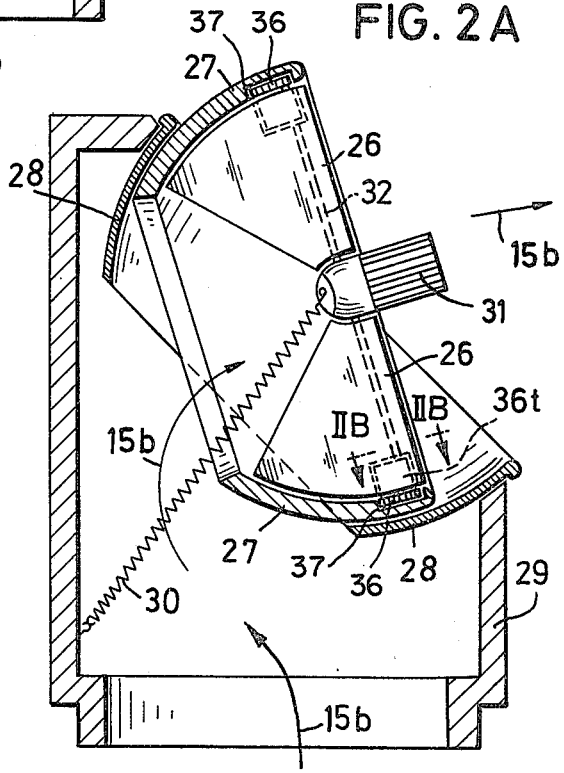
Figure 2C:
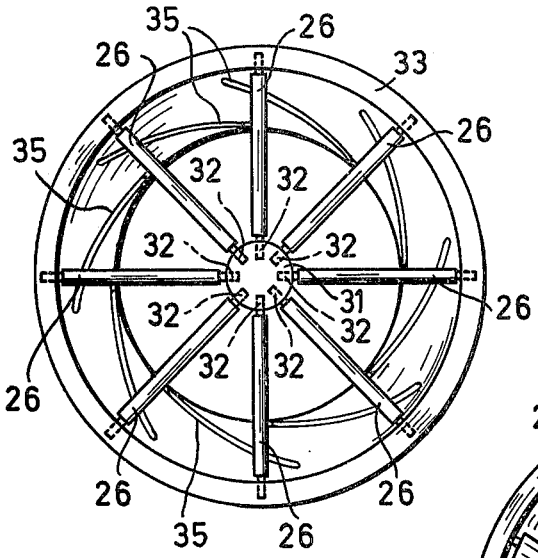
Figure 2D:
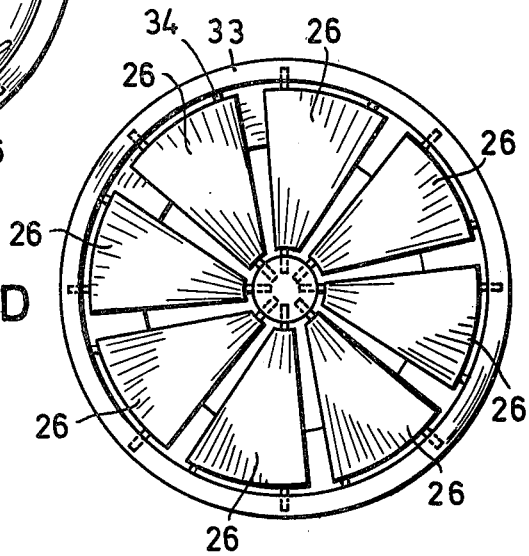
Figure 3:
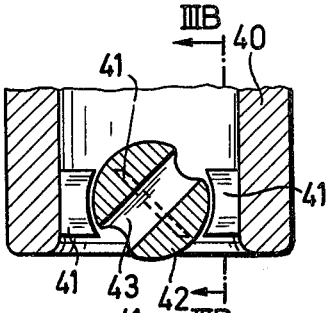
Figure 3A:
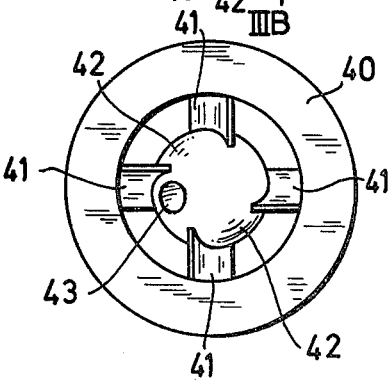
Figure 3B:
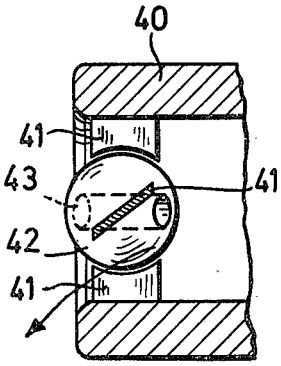
Figure 4:
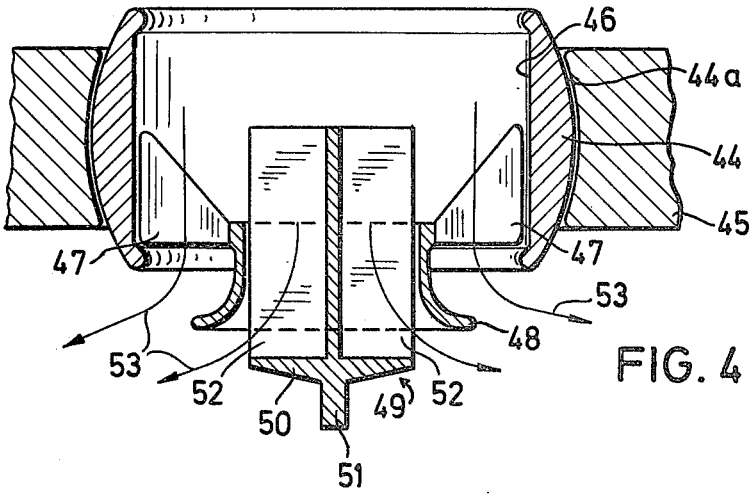
Figure 4A:
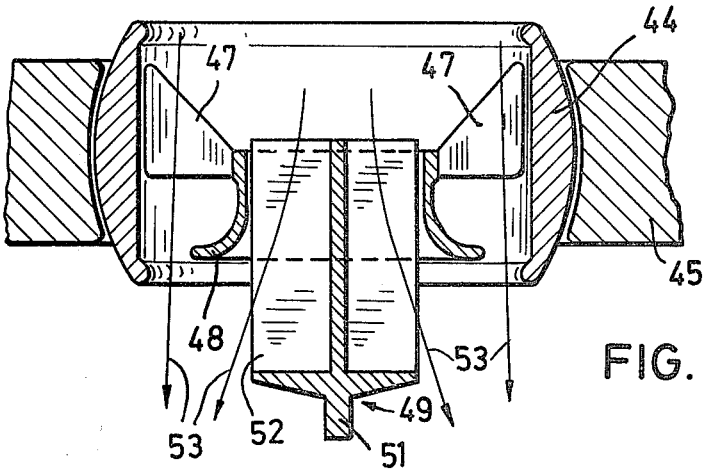
Figure 4B:
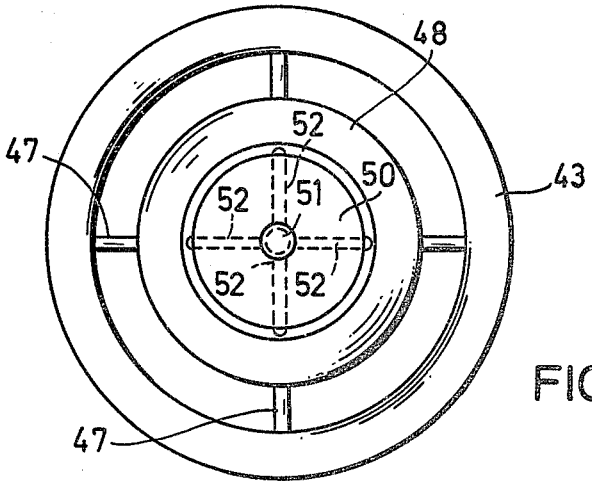
Figure 5:
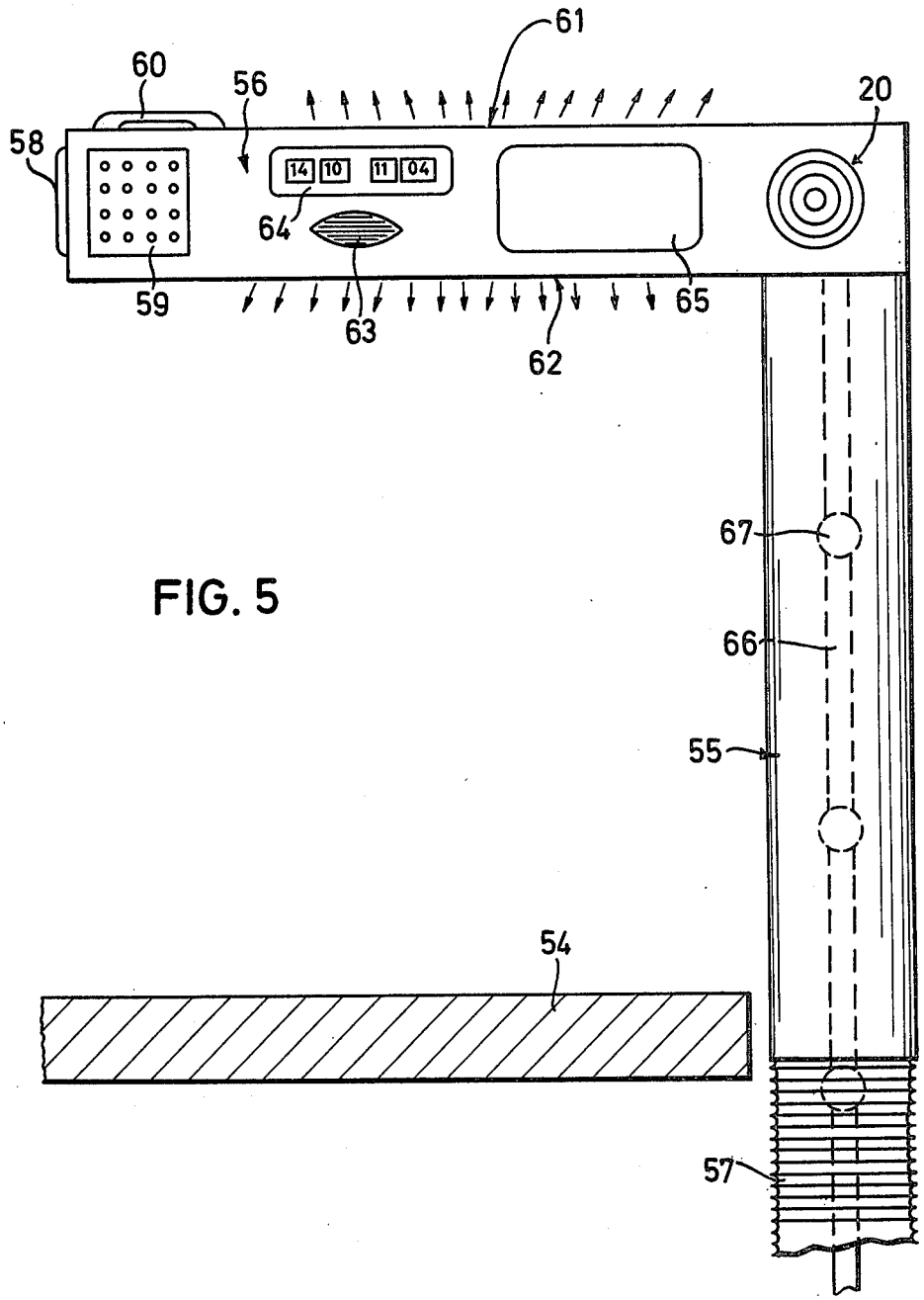

FIG. 2A, in its gross structure exhibits another directional position or setting for the air distributor head of FIG. 2, and also in certain structural detail discloses a modification in adjustment mechanism thereof;

FIG. 2B is an enlarged detailed sectional view of a part of FIG. 2A, the section being taken as indicated as IIB—IIB in FIG. 2A;

FIG. 2C is a front view of the adjustable portion of the air divider head of FIG. 2, the flow control vanes thereof being in fully open setting;

FIG. 2D is a view corresponding to FIG. 2C with the vanes therein set near closed position, or at a disposition sharply oblique to a central axis of the head;

FIG. 2E is a modification detail section;

FIG. 3 is an axial or longitudinal section through another adjustable air discharge device;

FIG. 3A is a front or end view of the device of FIG. 3;

FIG. 3B is a section taken as indicated by the line IIIB—IIIB in FIG. 3;

FIG. 4 is a longitudinal axial section through a further form of air outlet device;

FIG. 4A is a view similar to FIG. 4 with the device shown in another use setting;

FIG. 4B is a front or discharge end view of the device of FIG. 4;

FIG. 5 is a side view generally in elevation, of a support for an adjustable air outlet in association with other functional elements.

Figure 1:
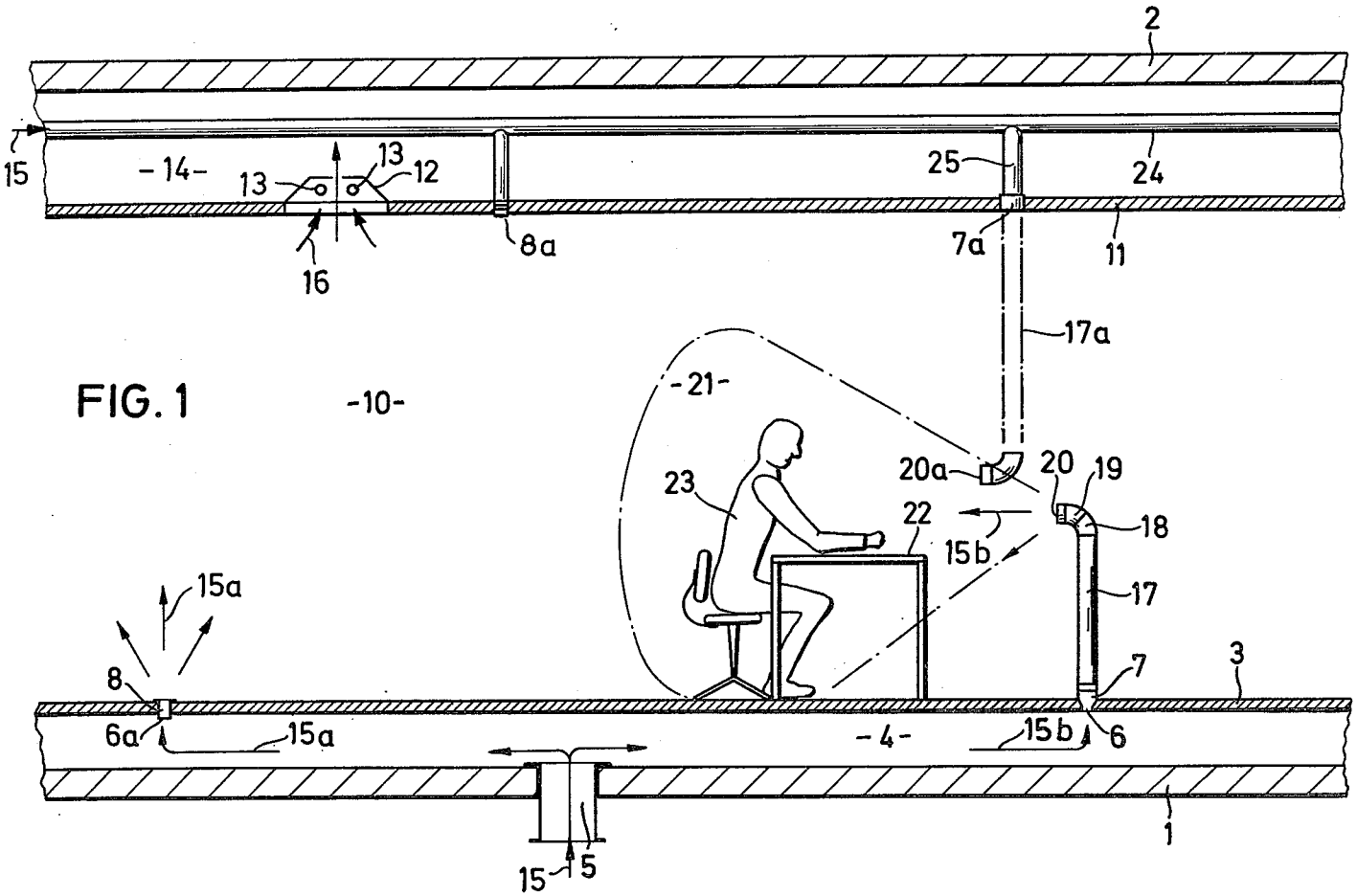
FIG. 1 is a vertical section through a room shown in fragmentary generalized schematic form to which the invention is applied.

In the drawings, FIG. 1 shows in rather generalized, schematic fragmentary form a large room and the associated building structure, wherein the primary building slab structures 1 and 2 in conjunction with respectively the service floor structures 3 and false or dropped ceiling 11, provide for the room what may be called respectively a double floor and a double ceiling, which of course, with the surrounding enclosing wall faces define an air-conditioned or ventilated room air space. But a portion of the room is here shown which is to be understood as representing a large room occupied by people having respective work places or stations, such as tables, desks or benches, where they spend considerable time, though only one such work station is indicated in the drawing. Particular details of building structure, of ventilating fan or air conditioning equipment, by which air is supplied to and withdrawn from the room, and other usual equipment, excepting certain air duct work, are not shown since per se involving no particular invention, and thus are not shown in detail.

In describing the method, system and device of the present invention the terms "primary air" and "zone (or supplemental) air" are used to designate portions or the respective quantities of the total quantity of the fresh or conditioned air supplied to the room, insofar as air is introduced into the room 10 at different types of locations by distinct means, acting diversely for specific functions. The term "supplemental" in this context implies nothing as to relative magnitude.

Between the slab 1 and the service floor 3, the intervening space of the double floor structure serves to accommodate air duct work or, with suitable dividers, itself forms one or more supply-air-carrying passages or ducts 4 to which, through one or more respective openings 5, fresh air or conditioned air is supplied by other known apparatus, either an installation serving this single room or a central installation for the building or several rooms. Similarly exhaust air duct space is provided in the double ceiling structure between the top or ceiling slab 2 and the dropped, suspended or false ceiling 11, (hereinafter without distinction usually termed "suspended") either to accommodate or, if expedient, with dividers, themselves defining the exhaust ducting as at 14. The floor slab of one story may of course be the top slab for a floor next below.

The air 15 thus supplied to the room, as indicated by arrows 15*b* and 15*a*, passes to various air supply points appropriately distributed in the service floor structure 3 as represented at 6 and 6*a* and later described, there to enter the room respectively as supplemental air and primary air portions of the total air supply.

Room air exhaust openings in the suspended ceiling 11, communicating with the discharge duct space 14, are provided at various appropriately distributed locations, for example, here by a light fixture 12, such as fluorescent fixture at which room air at 16 is discharging past the fluorescent tubes 13, through fixtures housing apertures into duct space 14; this exhaust duct space being in communication with an appropriate suction fan or return lines to a central air conditioning or ventilating equipment installation as previously described.

The supplemental air supply points 6 with associated receptacles or connection fittings 7, in case of an original construction preferably are distributed (in modular fashion) about the room to anticipate various possible future locations of work stations or the like, such as the desk location 22, and the connection fittings or air outlets receptacles 7 themselves, which also may incorporate electrical connectors and power supply receptacles, are then adapted to accept covers if not used. At the other locations 6*a* there are installed primary air floor outlet devices 8 appropriate for discharge of air directly into the room there to move upwardly with very low velocities and limited penetration in the manner previously adverted to in the introductory general description of the invention.

By this means the total quantity of air supplied is functionally divided into two parts, in the sense that a part or portion is discharged into the general air space of room 10 at the floor region through the outlet devices 8 with a very slight velocity in the room as the air for establishing the basic or primary climate for the room considered as a whole; while the remainder of the required air, the "supplemental air" is distributed to points 6 with supplemental air receptacles for connection to means whereby it is conducted to individual work stations or zones, for directed and regulatable discharge as hereinafter described.

At the zone of each work station 21, for example, a riser tube or stanchion 17 is secured at the bottom through coupling at receptacle 7 and has on its top, at an appropriate level relative to station occupant 23, an air distributing discharge head 20 supported by or including two 45° elbows rotatably connected to each other and to riser or station feed pipe 17, so that the air discharge direction accordingly is adjustable by the relative mobility of the parts.

To aim the air as desired, particularly advantageously head 20 has a structure which will cause the discharging air at 15*b* actually to diverge or fan out into the respective zone, in effect expanding in a cone 21, over the work station at table 22, generally surrounding the entire body of the occupant 23 of that particular room zone or region.

Cooperatively or alternatively, there can be, as shown at the top of FIG. 1, air supply conduit or duct means as at 24 with branches to ceiling outlets 8*a*, distributed appropriately and analogously to floor outlets 8, and also as at 25 to the air receptable fittings or couplings 7*a* similar to receptacles 7, but spaced in the ceiling structure. In the case of original construction, receptacles 7*a* again are spaced with a view to future possible work station locations and are closable when not used. With the branches 25 incorporated in air-conducting grid elements of a grid type suspended ceiling structure, receptacles 7*a* are then located in grid lower edges, but they may be in top edges. Receptacles 7*a* are adapted to take a drop tube, as indicated by dashed lines 17*a*, corresponding to riser 17. The drop tube in turn has an inverted discharge head 20*a* otherwise similar to that at 20 previously described.

In the case of both riser and drop tube installations, a user-surrounding cone of air of diminishing velocity and widening extent is achievable, the spread of which, i.e., the included conical angle, can of course be established by the discharge head. The simple mounting structure, comprised of the described rotatable 45° Ells, enables the centerline of the head or "axis" of the discharged air to be swung in effect in any direction included in a hemisphere about the riser. Larger ranges of adjustment may be used with appropriate structures. The change in air discharge direction can also be attained by use of feed tube components which are flexible for bending to desired position. Other discharge head forms are disclosed as hereinafter discussed.

Though for initial discussion the total quantity of air delivered to the room is symbolized by arrow 15 entering at 5 for distribution in the floor region divided as primary air to the general room space, symbolized by 15*a*, and supplemental air to work stations or other zones, symbolized at 15*b*, it should be understood that the total amount of air supplied to the room does not have to come through one common duct at the room structure itself such as those at 4 or 24.

OTHER DISCHARGE HEAD PARTICULARS — FIG. 2; FIG. 2A

FIGS. 2, 2A–2D represent both distinct air-directing positions and air flow settings for a first distinct form of discharge head 20B; and among them, FIGS. 2A–2B also further disclose a modification of a FIG. 2 mechanism enabling manual setting for air flow regulation.

Sector-shaped plate type vanes 26, are shiftably supported in a cup-like support shell or ring 27 of hollow spherical segmental shape, and define between themselves and ring 27 eight ultimate air discharge passages variable in a flow area and in effective direction of respective exiting air streams or jets.

The ring shell 27 itself, for limited universal shiftable support, is swivelly received in a head base socket formed by a similar spherical segment ring 28, affording a spherical internal female surface accepting the male exterior of shell ring 27. With hollow head base 29, the socket ring 28 constitutes a hollow head housing having an air outlet opening through 28 and an inlet opening for air designated 15*b* going into base 29, at which the head is connectable to a supplemental air supply tube, such as 17 or 17*a* of FIG. 1, in a manner either fixed or swingable around the riser or drop tube axis.

From a central knurled grip knob 31, disposed coaxially to ring 27, equispaced vane support rods or pivot shafts 32 extend out radially to outboard end support in the broad mouth marginal or rim region of the cup-shaped structure of ring 27 to swingably support the vane set arrayed in an assembly of ring 27, vanes 26 and actuating mechanism to be detailed. This assembly is retained seated in the head socket by a stretched tension spring 30 with ends secured to a wall of base 29 and the back end of knob 31 and disposed generally along the axis of socket ring 28.

The vanes are swingable, preferably from a full open position setting (FIGS. 2, 2A, 2C) aligned with the cup axis on through intermediate oblique position settings (e.g., FIG. 2D) to a maximally closed position setting, coplanar in a plane perpendicular to the cup axis, either by pivoting on or about rods 32 or, where the vanes are quite bendible, by flexing about the rods; and hence adjacent the cup interior have corresponding curved peripheries.

By this mounting, the vane and cup assembly and its axis have a fairly wide, though limited, swiveling or universal movability relative to the housing, (compare extreme positions, FIGS. 2 and 2A, for cup swing in one plane), and hence there is a like shiftability of what might be called the primary head axis of the discharge of air, an axis of symmetry for the respective "axes" or discharge directions of individual streams or discharge jets issuing in various directions, from vane-defined outlet passages, depending upon the vane setting. This swivel shiftability in a sense is additive to that available by rotation or swivelling of the entire head about the axis (e.g., vertical in FIG. 2) of an air feed tube, at the point of head-to-tube connection, e.g., as described for FIG. 1.

In FIG. 2, vane array setting mechanism is provided by fixed end support of shafts 32, at the inner ends in knob 31 and at outer ends in a shift ring 33. The latter, as a shiftable rim element on cup or ring 27, has an external rabbet on its inner end received as a male part in a rim seat afforded by a complementary rabbeted outer circular edge of 27, at which a rotation sliding retention means or inter-engagement (see FIG. 2E sectional detail) is aptly provided, additionally or alternatively to the retention afforded by spring 30. Especially where at least one of elements 27 and 33 is fabricated of resilient synthetic plastic, the formations appearing in FIG. 2E represent a simple expedient for attaining the retentive engagement. Thus a rigid frame is formed with shafts 32 as radial spokes on which vanes 32 are swingable, responsive to manual rotation of the frame imparted at the projecting knob 31, in consequence of a camming action on each vane engendered through a projecting vane lug 34 engaged and tracking in a respective curved camming groove 35 (see FIGS. 2 and 2C) in the interior surface of cup shell 27; with counter-clockwise turning here effecting closure.

In FIG. 2A, for the vane-setting modification (see also detail of FIG. 2B), the rim of ring 27 is internally rabbeted to form an internal shoulder at 37 toothed to form a circular rack or face gear on which, in effect, the outer end of each blade is supported through meshing vane-attached gear segment 36. Thus again rotation of knob 31, (here clockwise for closure) with spoke-like shafts 32 carrying vanes 26 and meshed gear segments 36, causes the latter to rotate relative to, and blades 26, to swing on shafts 32; clearance of course being provided for the upswinging ends of the gear segments.

For each vane 26, the shaft rod 32, the gear segment 36 and the vane may be rigidly connected, with rod 32 being rotatably supported in knob 31. Or the shaft rods 32 may be rigidly secured with the knob 31, with the vane then being rotatable on the rod 32 by the gear segment 36 secured in or to the vane, for example, by a perpendicular rectangular tang plate of the segment received in a corresponding deep edge recess of the vane as indicated by the dotted lines 36*t*.

Other discharge head forms, also adjustable without use of tools, are disclosed in the other figures.

In this discharge head form, with the swingable blades of FIGS. 2–2D, at the extreme open setting (i.e., with the planes of vanes 26 passing through the system axis, or perpendicular to a plane perpendicular to that axis), the several jet "axes" or general flow directions tend at 15b to run out more or less parallel to or be grouped around that system axis, coincident with the common axis of 31 and 27; a more or less axial flow into the room resulting.

At the other extreme setting, with vanes 26 swung into a common plane perpendicular to the system axis, the discharge head is shut off for practical purposes, though minor leakage of course is acceptable. At stepless, continuous intermediate settings, the jets will issue obliquely, deflected away from parallelism with the system axis, in a manner which tends to impose some radial diverging spread and a rotational motion upon the discharge air of the group as a whole, for the discharging air to spread out into the respective zone.

DISCHARGE HEAD OF FIG. 3

In FIGS. 3-3B, the discharge head is comprised of an annularly cylindrical body 40, near the bore mouth of which a plurality of at least three, here four, equiangularly spaced, like vanes 41, are fixed on and project inwardly from the body bore wall to support a ball 42 having a diametric air passage bore 43. Vanes 41 are disposed obliquely to the bore axis of body 40, and have inner end edges curved conformably to the spherical surface of ball 42 jointly to form a ball seat in which the ball is universally swivelly mounted, for corresponding variability of the ball bore axis, and hence of the discharge direction of an air jet issuing from the ball bore. Flexibility of the vane material (e.g., when made of a plastic) is one simple expedient to allow exchange of balls as well as original assembly of the ball into its seat. Also the ball may be elastic rather than rigidly hard.

For vehicle installations, from safety considerations, the mentioned plastic construction is expedient.

The passages defined between the array of oblique vanes 41, the bore wall of body 40 and exterior of ball 42 result in respective air discharge jets or streams outwardly divergent, symmetrical about the axis of 40 as a system or symmetry axis. The jet from ball passage 43 may be changed from a system axial direction to diverse azimuths more or less inclined to the system axis, about the entire compass of the body axis and with selectable obliquity to that axis. This latter jet, by fluid induction action, can as well influence and deflect the other jets and as a control jet, change the spread pattern of the otherwise "fixed" jets issuing between the vanes, to produce a desired air distribution or discharge pattern.

If the ball passage is transversely disposed, precisely at right angles to the system axis, no air issues therefrom, and the air discharges from the head with maximum and symmetrical spread. The ball can also include a shutoff valve means wholly or partially to occlude its passage, and thereby reduce the velocity of its directing jet and its effect.

The vanes are preferably obliquely disposed to obtain a rotational or twisting character in the air discharge from the head.

However, the vanes can also have a fixed disposition in the axial direction especially with the next-described design.

The exterior surface of the ball (which also may be elastic or plastic) can be crossed by at least three air guide passages with non-parallel symmetrically disposed axes, the direction of which again can be changed by setting of the ball orientation.

DISCHARGE HEAD FROM — FIG. 4

In FIG. 4, the discharge head is comprised of four principal parts, the first being a fragmentarilly indicated body, in the body wall 45 of which an aperture, with spherical curvature complementary to like exterior curvature at 44a of a ring 44, affords a seat or socket in which the ring 44 is again universally swivelly retained. In the central bore of ring 44, an air-dividing or distributor member 48, of outwardly flaring tubular form, is axially shiftably supported at its inner end by four integral radial vanes 47 slideably engaging on the ring bore cylindrical surface 46 terminated at opposite ends by inward circumferentially continuous stop-lips. A further insert member 49 in turn is axially shiftable in the inner annularly cylindrical tube part of member 48.

Member 49 includes end wall disk 50, grip 51 and four centrally axially joined equi-angularly disposed rectangular partition plates 52, (see also FIG. 4B), the longitudinal edges of which provide extended slidable support in the cylindrical part of member 48. The axial partitions 52 also serve to divide the tubular part of member 48 into four air passages. The extreme outward position of member 48 and an intermediate position of member 49 are represented in FIG. 4; and in FIG. 4A, a nearly inmost setting of 48, and an extreme outward setting of member 49 relative to their respectively supporting structures. The two axially shiftable members may be respectively integrally formed, e.g., of molded plastic.

Thus a plurality of at least three, here four, air discharge passages are defined by each of the arrays or vane sets of the shiftable members, taken in conjunction with respectively surrounding wall structures. The streams or jets issuing from these passages, as indicated by the several air flow arrows 53 in FIGS. 4 and 4A, have discharge directions changeable from nearly axial, to more or less lateral, i.e., radial, and thus spreading, depending upon the relative axial positioning of the shiftable members.

Thus, in FIG. 4 for the settings shown, and with the outward flare of 48 notably effective, the streams issuing between 45 and 48, and also from between 48 and 49, are markedly deflected from axial and are strongly outwardly divergent. But with tube 48 axially displaced inwardly (FIG. 4A) the deflection from axial is abated for the jets issuing between 45 and 48; these rather issuing substantially axially, but, as the flow opening area is decreased, with a higher pressure drop.

On the other hand, to the extent that member 49 is shifted inwardly in member 48, then the central group of passages is correspondingly closed, so that the pressure drop of the air issuing externally of tube 48 is correspondingly increased. Thus a quite varied type, direction and distribution of air jet discharge is available by virtue of the axial shiftability of members 48 and 49, conjoined with the universal swivelling movement of the two members as an assembly in 45.

The vanes 47, axially extending in the figures, can also be disposed obliquely or have a twist shape, to impart corresponding motion to air; and with appropriate clearances may be made of bendable material for selective shaping.

FIG. 5 ARRANGEMENT

As noted, the supplemental air outlets 20 may also be located in furniture pieces or other equipment at a work place as well as on riser or drop tubes, especially in modular room construction.

Thus in FIG. 5, adjacent a desk or writing table 54, a hollow column 55 comprised of an external tube of plastic, rubber or the like bendable material and internally supported by an interior articulated core or skeleton 66–67, at its upper end supports an outrigger member or cantilevered arm structure 56 in which there is located an air outlet fitting or discharge head 20, which may have any appropriate structure such as those disclosed for the above described forms relative to FIGS. 2–4. The core 66–67 enables the column, hence support 56, to be set without tools to, and maintains it at, selected positions.

The column 55, receiving supplemental air from below at a movable tube coupling structure 57 for delivery to outlet 20, also encloses electric wire cables or harnesses, to components on arm 56, such as the electrical receptacle or outlet 58, the switch keyboard or array 59, for various purposes, such as room light control at the desk, a telephone 60 for which 59 can be the keyboard or a dialing switch, a small ceiling illuminating lamp at 61, a work place lamp 62, an intercom speaker 63, a digital electric clock 64, and a television tube 65 for display of information.

The column, arm and equipment assembly of FIG. 5 may be located at the position of a riser 17 in FIG. 1, the column structure then becoming in effect the riser; and likewise may be dependent from the ceiling structure as at 17*a* in FIG. 1. The here bottom end of column 55 then includes structure cooperative with the air connection receptacles at 7 (or 7*a*) for air-tight and supportive connections mechanically, pneumatically and electrically with corresponding electrically and mechanical outlet or joint expedients at 7 (or 7*a*).

What is claimed is:

1. In an air conditioning system of a room used by persons occupying one or more zones, such as work stations or the like, in which a volume of fresh air fed into the room is divided into two parts, a first part of which is fed with a low velocity into the room to establish in the latter an overall primary climate and a second part of which is fed through regulatable air discharge devices in air streams differing in velocity from said low velocity to at least one of said zones so as to provide a person occupying said zone with a local climate differing from said overall climate in said room, each of said regulatable air discharge devices through which supplemental air forming a portion of said second part of fresh air is blown into the room comprising a unit having at least three air conducting passages by which discharging supplemental air is directed, each passage having an axis establishing the direction of the respective discharge stream flow, said passages being simultaneously adjustable without tools to thereby adjust the direction of the respective axis.

2. A device as described in claim 1, wherein:
the differently adjustable axis directions of the air passages or flow directions of the blown air diverge from an imaginary central discharge axis of the air discharge head.

3. A device as described in claim 1, wherein:
in a single unit at least three adjustable air conducting passages are defined by an array of guide vanes mounted, in an air discharging support, for rotation about respective axes.

4. A device as described in claim 3, wherein:
the rotation axes of the guide vanes are disposed in a plane radial to the said discharge axis of the air discharge head.

5. A device as described in claim 4, including:
a manual adjustment mechanism for the vanes,
said mechanism having a central rotation knob about which the vanes are arrayed.

6. A device as described in claim 5, wherein:
said vanes are supported on pivot shafts projecting radially from the central rotation knob;
outboard ends of said shafts being supported at least mediately in a nearly hemispherical open-bottomed cup-like shell as said support;
said device further including a support socket with a spherical inner surface, wherein said shell is supported for a limited universal swivel motion.

7. A device as described in claim 6, including:
a tension spring with ends respectively secured to the back end of the central knob and to supporting wall structure for the socket;
said tension spring urging the said shell into the support socket as a seat.

8. A device as described in claim 6, including:
a shift ring rotatable on the forward rim edge of the said shell;
the outboard ends of the said pivot shafts being supported in said shift ring to constitute a rigid frame with said knob and shift ring;
said vanes on their outer peripheral edge each having a lug projecting into slideable engagement with a respective camming groove in the interior surface of said shell;
whereby, upon rotational shift of the frame, the vanes are simultaneously shifted to vary air outlet passages defined therebetween.

9. A device as described in claim 7, including:
a circular rack or face gear formation about the interior periphery of the mouth of said shell; and
respective gear segments connected to the vanes and meshed with said rack formation;
whereby, upon rotational shift of the frame, the vanes are simultaneously shifted to vary air outlet passages defined therebetween.

10. A device as described in claim 1, wherein:
said air conducting passages are rigidly incorporated in a unit; and
said device includes means for changing the air discharge effect of the passages without tools by throttling or closure of individual passages.

11. A device as described in claim 1, wherein:
the said air conducting passages are defined by differently extending fixed guide vanes; and, in combination with said passages, at least one further air conducting passage adjustable in the direction of its discharge axis.

12. A device as described in claim 11, wherein:
said fixed vanes are disposed on the round wall of a principal air outlet of the device and at like angles to the air outlet axis and to one another; and
said further passage is provided in a ball universally swingably supported centrally of said vanes.

13. A device as described in claim 12, wherein the said vanes form a seat for the ball.

14. A device as described in claim 1, including:
a support element having a round opening as the air outlet of the device; and
an insert element coaxially vane-supported axially displaceable in said opening and, with the circumference of the opening, defining said air conducting passages;

change of the passage air discharging axes, determinative for a stream flow deflection, being produced by a selectable axial displacement of the insert in said outlet opening.

15. A device as described in claim 14, including:

as said support element, an annular element with a spherically shaped outer surface, in turn universally swingably disposed in a socket formation of the device;

said insert element integrally comprised of an outwardly flaring guide tube and at least three spaced radial vanes slideably engaged coaxially in the opening of the annular element; and, within the guide tube, a second axially shiftable insert element defining further air discharge passages with said guide tube.

16. A device as described in claim 15, wherein:

the said second insert element includes partitions and a front wall defining at least three passages from said guide tube and thereby defining air outlets adjustable in degree of lateral discharge by axial positioning of said second insert in the guide ring.

17. A device as described in claim 1, in combination with tubular air conduit means, whereby the device may be coupled to, and serve as a respective discharge head at, a supplemental air supply receptacle for a respective zone.

18. A device as described in claim 17, wherein:

said tubular conduit means includes an easily bendable tubular element, preferably of corrugated metal, plastic or rubber, having a supporting core or skelton which is adjustable without tools.

19. The combination as described in claim 17, including:

electrical receptacle means and illumination means for service to a respective zone assembled in a module with the air discharge head; and respective electrical lines enclosed within said tubular conduit means for connection of said receptacle and illumination means to appropriate sources.

20. A system utilizing the combination as described in claim 17, and wherein:

the floor structure and ceiling structure of the room include at least one structure having supplemental air supplying receptacles proximate to said zones of the room;

said receptacles and tubular conduit means being adapted for an air-tight engagement.

21. A system as described in claim 20, wherein:

said receptacles are rigidly supported at the ceiling region of the room.

22. A system as described in claim 21, including a grid-type suspended ceiling structure; certain grid elements therein affording supplemental air supply conduits, whereon the said receptacles are located.

23. A system as described in claim 20, wherein:

the floor structure comprises a double floor enclosing air supply ducts and including said receptacles located in the service surface of the floor.

24. A system as described in claim 1, wherein at least one of said zones is established by a furniture module which includes said regulatable air discharge device.

25. A method of air conditioning a room used by persons occupying one or more zones, such as work stations or the like in the room by feeding a volume of fresh air into said room, said method comprising the steps of dividing said volume of air to be fed into the room into two parts; feeding a first part of said air with low velocity into the room to establish in the latter an overall primary climate; feeding a second part of the air through regulatable air outlet means in an air stream with a velocity higher than said low velocity to at least one of said zones so as to provide a person occupying said zone with a local climate differing from said overall primary climate; and spreading said air stream to a variable degree.

26. A method of air conditioning a room used by persons occupying one or more zones, such as work stations or the like by feeding a volume of fresh air into the room, said method comprising the steps of dividing the volume of air into two parts; feeding a first part of said air with low velocity into the room to establish in the latter an overall primary climate; feeding a second part of said air through individual regulatable outlet means into the room; and deflecting said part of air passing through the regulatable outlet means in the latter to a variable degree so that the air enters the room with a correspondingly varied velocity differing from said low velocity to provide a person occupying said zone with a local adjustable climate differing from said overall climate in said room.

27. A method as described in claim 26, wherein said second part of the air is fed through said regulatable outlet means at a velocity higher than said low velocity.

* * * * *